US006037923A

United States Patent [19]

Suzuki

[11] Patent Number: 6,037,923

[45] Date of Patent: Mar. 14, 2000

[54] ACTIVE MATRIX DISPLAY DEVICE

[75] Inventor: Koji Suzuki, Kanagawa-ken, Japan

[73] Assignee: Kabushiki Kaisha Toshiba, Japan

[21] Appl. No.: 08/819,191

[22] Filed: Mar. 17, 1997

[30] Foreign Application Priority Data

Mar. 19, 1996 [JP] Japan ..... 8-063259

[51] Int. Cl.[7] ..... G09G 3/36

[52] U.S. Cl. ..... 345/92; 345/90

[58] Field of Search ..... 345/92, 90, 94, 345/96, 100; 349/47

[56] References Cited

U.S. PATENT DOCUMENTS

| | | | |
|---|---|---|---|
| 4,621,260 | 11/1986 | Suzuki et al. | 345/92 |
| 4,818,981 | 4/1989 | Oki et al. | 345/92 |
| 5,012,228 | 4/1991 | Masuda et al. | 345/92 |
| 5,289,174 | 2/1994 | Suzuki . | |
| 5,483,366 | 1/1996 | Atherton | 359/87 |
| 5,568,163 | 10/1996 | Okumura | 345/92 |
| 5,734,453 | 3/1998 | Takemura | 345/92 |

FOREIGN PATENT DOCUMENTS

| | | | |
|---|---|---|---|
| 403043786 | 7/1989 | Japan | 345/92 |
| WO 91/02999 | 8/1990 | Japan | 345/92 |
| 405210089 | 1/1992 | Japan | 345/92 |

OTHER PUBLICATIONS

T. Maekawa et al.; "A High–Resolution 0.7–in.–Diagonal TFT–LCD", SID Symposium Digest, vol. XXIII, May 17–22, 1992, pp. 55–58.

*Primary Examiner*—Richard A. Hjerpe
*Assistant Examiner*—Ronald Laneau
*Attorney, Agent, or Firm*—Finnegan, Henderson, Farabow, Garrett & Dunner, L.L.P.

[57] ABSTRACT

With this active matrix display device, in a liquid crystal display panel comprising an array substrate (1) on which there are formed, on the same substrate, thin film transistors (11) respectively connected to two-dimensionally arranged pixel electrodes and drive circuits (2,3) that drive them, a counter substrate arranged facing this array substrate (1), and a liquid crystal layer (12) inserted between array substrate (1) and the counter substrate, part of the power source supply wiring of drive circuits (2, 3) is formed by reference potential wirings (Cs lines) (20) of storage capacitors (14) provided at each pixel in the display region, thereby enabling lowering of the resistance of the power source wiring of the power source applied to the drive circuits to be achieved without increasing the border region, and enabling the border region to be made narrow and reliability to be improved.

26 Claims, 5 Drawing Sheets

ACTIVE MATRIX DISPLAY DEVICE

BACKGROUND OF THE INVENTION

1. Field of the Invention

The present invention relates to an active matrix display device incorporating a device circuit, and in particular relates to an active matrix display device in which the power supply wiring is improved.

2. Description of the Related Art

Of display devices, liquid crystal display devices have the characteristic advantages that they are of small thickness and light weight, and can be driven by low voltage and color display can easily be obtained. In recent years they have come to be widely employed as display devices for personal computers or word processors etc. In particular, an active matrix type liquid crystal display device, in which thin-film transistors(TFTs) are provided as pixel switching elements at each pixel is an ideal system for display devices for OA use or full-color televisions. The reason is that, even for a large number of pixels, there is no deterioration of contrast or response and intermediate levels of luminance can be displayed.

Such an active matrix liquid crystal display device principally consists of two flat glass substrates(array substrate and counter substrate) and a liquid crystal layer sandwiched between these substrates. A color filter and transparent electrode(counter electrode)are formed corresponding to each pixel at the surface of the counter substrate, which constitutes one of the glass substrates. On the other substrate i.e. the array substrate, there are provided pixel electrodes consisting of transparent electrodes arranged in matrix fashion and TFTs whose source electrodes are connected to each pixel electrode. The gate electrodes of these TFTs are connected to address lines arranged in the X direction, while their drain electrodes are connected to data lines arranged in a direction at right angles to the address lines.

In a conventional active matrix liquid crystal display device constructed in this way, voltages corresponding to picture data can be selectively applied to each pixel electrode by applying respective address signals and data signals to the address lines and data lines with prescribed timing. The optical transmittance of the liquid crystal layer can be controlled by altering the voltage difference between the counter electrode and pixel electrode and any desired display images can be realized by this technique. Details are given in an article by T. P. Brody et al.(IEEE Trans. on Electron. Devices, VOL.ED. Nov. 20, 1973, pp. 995–1001).

Amorphous Si or polycrystalline Si etc. are typically employed as the semiconductor material forming the channel regions for the TFTs. In active matrix liquid crystal display devices, which have become most common in recent years, the TFTs for pixel switches are formed by amorphous Si on a glass substrate and a packaged LSI which is stuck on to the peripheral region of a glass substrate and connected to the TFTs which are used for pixel switching. An active matrix liquid crystal display device using polycrystalline Si achieved a further improvement of the active matrix liquid crystal display device.

Owing to the fact that the TFTs for pixel switching and the device circuit for applying drive signals to the address lines and data lines can be formed on the same glass substrate, such a liquid crystal display device has the advantages that the entire liquid crystal display device can be made of small size and high reliability of the wiring connections can be obtained. FIG. 1 is a view showing the construction of an active matrix liquid crystal display device using polycrystalline Si TFTs incorporating conventional device circuits. An array substrate 1 is formed with an array of TFTs 11, data line drive circuits 2 and address line drive circuit 3 etc. In addition, this array substrate 1 and a counter substrate 6, formed with counter electrodes 13, are arranged facing each other, and a liquid crystal layer 12 is sealed between these substrates 1 and 6 to complete the construction. Drive circuits 2,3 input prescribed signals from respective signal input terminals 9,10 and apply drive signals to respective data line 4*a*,4*b*,4*c*~ and address lines 5*a*,5*b*,5*c*~, thereby driving the TFTs 11 of each pixel.

The problem with an active matrix liquid crystal display device incorporating such a drive circuit was how to make the low impedance of the power wirings 7,8 that apply power supply voltage to drive circuit 2,3. Usually, special materials such as Ta, TaMo, or MoW that are not used in LSIs etc. are used to provide wiring material of low resistance and sufficient ability to withstand the highly acidic etching liquids such as aqua regia that are employed in the etching step of the transparent electrodes such as ITO in an active matrix liquid display device. No better materials have been discovered and resolution of the problem of the wiring material is difficult. In order to obtain lower resistance, it was therefore necessary to adopt expedients such as increasing the wiring width or providing additional power source supply terminals 7*b*,8*b*,7*c*,8*c* at a plurality of locations on substrate 1 rather than just power source supply terminals 7*a*,8*a* from the outside.

However, increasing the width of the power source wiring tends to increase the area dedicated to utilities in other words the border region or non-display region at the periphery of the display region where the pixels are formed, and thus tends to increase the size of the substrate and hence the liquid crystal display device as a whole.

Also, with a construction in which power supply terminals are provided in a plurality of locations, connections with external wiring are increased, and the number of places where different sets of wiring cross each other, such as for example, the places where the lines to signal input terminals 9 and address line drive circuit 3 are increased, giving rise to the risk of short circuiting. In order to eliminate such points of cross-over wiring detours are necessary, but there increase the size of the border region constitution the wiring region, so in this respect also miniaturization of the liquid crystal display device cannot be achieved.

Summarizing these problems, miniaturization of liquid crystal display device as a whole cannot be achieved because the non-display region at the periphery of the display region cannot be reduced in size. The arrangement is not particularly desirable from the point of view of reliability because the proliferation of points of cross-over of power source wiring and other wiring increases the risk of short circuiting between wirings.

Such problems do not manifest themselves with severity in small liquid crystal display devices of about 5-inch size using polycrystalline TFTs, but silicon cause as particularly important problems in connection with large active matrix liquid crystal display devices of 10-inch size or more.

SUMMARY OF THE INVENTION

As described above, with the conventional active matrix liquid crystal display device incorporating drive circuits, as the device is made larger, the area occupied by the wiring region becomes larger, and suitable expedients regarding the wiring for supplying power to the drive circuits become an important problem. Attempts to solve these problems by the use of suitable wiring materials were made but this was difficult and there was no other method of solving them apart from using thicker wiring. However, even if the wiring thickness is increased, reliability is impaired due to the complexity of the wiring and when attempts are made to miniaturize large-screen, drive circuit-incorporating active matrix liquid crystal display devices. This fact has prevented the realization of large-screen, drive circuit-incorporating active matrix liquid crystal display device employing polycrystalline Si TFTs.

Taking the above circumstances into consideration, the object of the present invention is to provide an active matrix display device of the type incorporating a drive circuit wherein the resistance of the power supply wiring to the drive circuits can be lowered without increasing the size of the non-display region, and wherein the borders can be made narrower and reliability improved.

In order to solve the above problems, the following construction is adopted.

Specifically, an active matrix display device according to the present invention comprises: an insulating substrate; a display region formed on this insulating substrate, comprising a plurality of active elements arranged in matrix fashion and a plurality of pixel electrodes that receive the voltage from said active elements, arranged paired with these active elements and in the vicinity of said active elements; an address drive circuit formed in a non-display region other than said display region on said substrate, and which performs ON/OFF control of said active elements by supplying an address signal to said active elements; a data drive circuit for supplying picture data to said active elements formed in a non-display region on said substrate, and a counter electrode formed facing said pixel electrodes; a liquid crystal layer formed between this counter electrode and said pixel electrodes, whose transparency is controlled by the electrical field applied between said pixel electrodes and said counter electrode; and a power source supply wiring formed in said display region and that supplies essentially power source potential to said address drive circuit or data drive circuit.

Also, an active matrix display device according to the present invention comprises; an insulating substrate has two opposite main surfaces, the middle part of one main surface constituting a display region while the rest constitutes a non-display region; a plurality of active elements formed in said display region and two-dimensionally arranged; a plurality of pixel formed in said display region, whereof the amount of light emitted is controlled by said active elements; a drive circuit formed in said non-display region and that drives said active elements; a power source supply wiring formed in said non-display region and that supplies power source potential of said drive circuit; and groups of wirings that act substantially as said drive circuit potential supply source formed in said display region and connected at a plurality of locations with said power source supply wiring of said drive circuits.

In this connection, the following may be cited as desirable modes for putting the present invention into effect.

(1) By connecting the power source supply wiring with the address drive circuit or data drive circuit at a plurality of locations in the non-display region, a much more stable substantial power source potential can be supplied than if connection is effected at one location only.

(2) Apart form GND, the power source potential could be made a ±power source potential higher or lower than GND.

(3) The active elements for pixel drive and the active elements for circuit drive of the address drive circuit and data drive circuit etc. could be TFTs whose channel regions are polycrystalline Si.

(4) The reference potential wiring of the storage capacity provided to each pixel in the display region i.e. the Cs line could be employed as part of the power source supply wiring.

(5) The address drive circuit may be divided between non-display region to the left and right of the display region, these being mutually connected by address lines passing through the display region.

(6) The Cs lines and power source supply wiring for the address drive circuit may be simultaneously connected at one side and another side in the vicinity of two different said (in particular, opposite each other) of a display region presenting the shape of a rectangle having four sides.

(7) The Cs lines may be grouped into at least three groups, being respectively supplied with GND potential, ±power source potentials for the logical circuitry of the address drive circuit, and an intermediate power source potential between the GND potential and ±power source potential, for the TFT address voltage.

(8) The black matrix of each pixel consisting of metallic thin film formed in the display region may be employed as part of the power source supply wiring.

(9) The data drive circuit may be divided between non-display regions above and below the display region, these being mutually connected by data lines that pass through the display region.

(10) The black matrix may be capacitively coupled with a data line by forming this superimposed on the data line.

(11) The black matrix of each pixel and the Cs wiring provided at each pixel in the display region may be employed as part of the power source supply wiring.

(12) A plurality of Cs wirings may be divided into a plurality of groups, each group being supplied with a different power source potential.

Thanks to the use of wiring(Cs line, black matrix etc.) formed in the display region for part of the power source supply wiring of a drive circuit, low-resistance power source supply wiring for the drive circuits can be achieved without increasing the size of the border region. And in this case, since these wirins are arranged essentially two-dimensionally within the display region, even when large-screen high-resolution liquid crystal display panels are employed, there is scarcely any increase in wiring resistance.

Also, in the case of a large-screen high-resolution liquid crystal display panel, the number of pixels is increased, thereby increasing the number of wirings of the Cs lines and/or black matrix formed in the display region, with the result that increase in wiring resistance is avoided. This solves the problem previously experienced since conventionally the wiring was arranged one-dimensionally outside the display region, use of a large screen unavoidably increased wiring resistance. Furthermore, such wiring raises the display quality of the TFT-type liquid crystal display device and has the characteristic that it can be realized without adding a special manufacturing step.

Furthermore, this construction of the wiring of the Cs lines and black matrix lines, in which they are employed as power source wiring, offers advantages in regard to their use as drive circuit power source wiring, in that stray capacitance exists between the wiring and the liquid crystal layer and the total capacitance that is connected in parallel with the power source wiring can therefore be made larger, compared with the case where power source wiring is formed only in the non-display region. Thus this wiring arrangement combines the function of a bypass filter, which is necessary for stabilization of the power source potential.

DETAILED DESCRIPTION OF THE PREFERRED EMBODIMENTS

Figure 1:
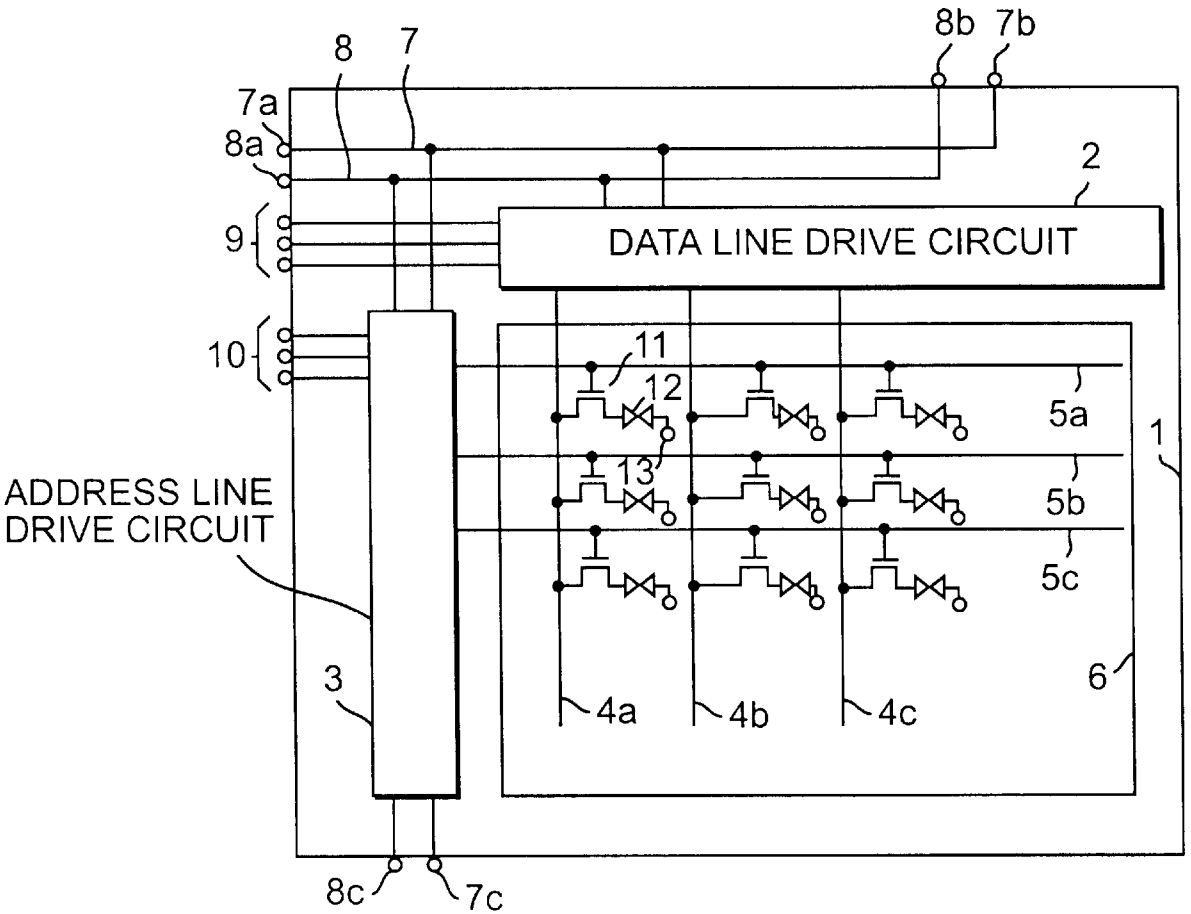
FIG. 1 PRIOR ART
FIG. 1 is a block diagram illustrating the construction of a liquid crystal display device incorporating a drive circuit of a prior art construction.

Details of the present invention are described below with reference to embodiments illustrated in the drawings.

(First embodiment)

Figure 2:
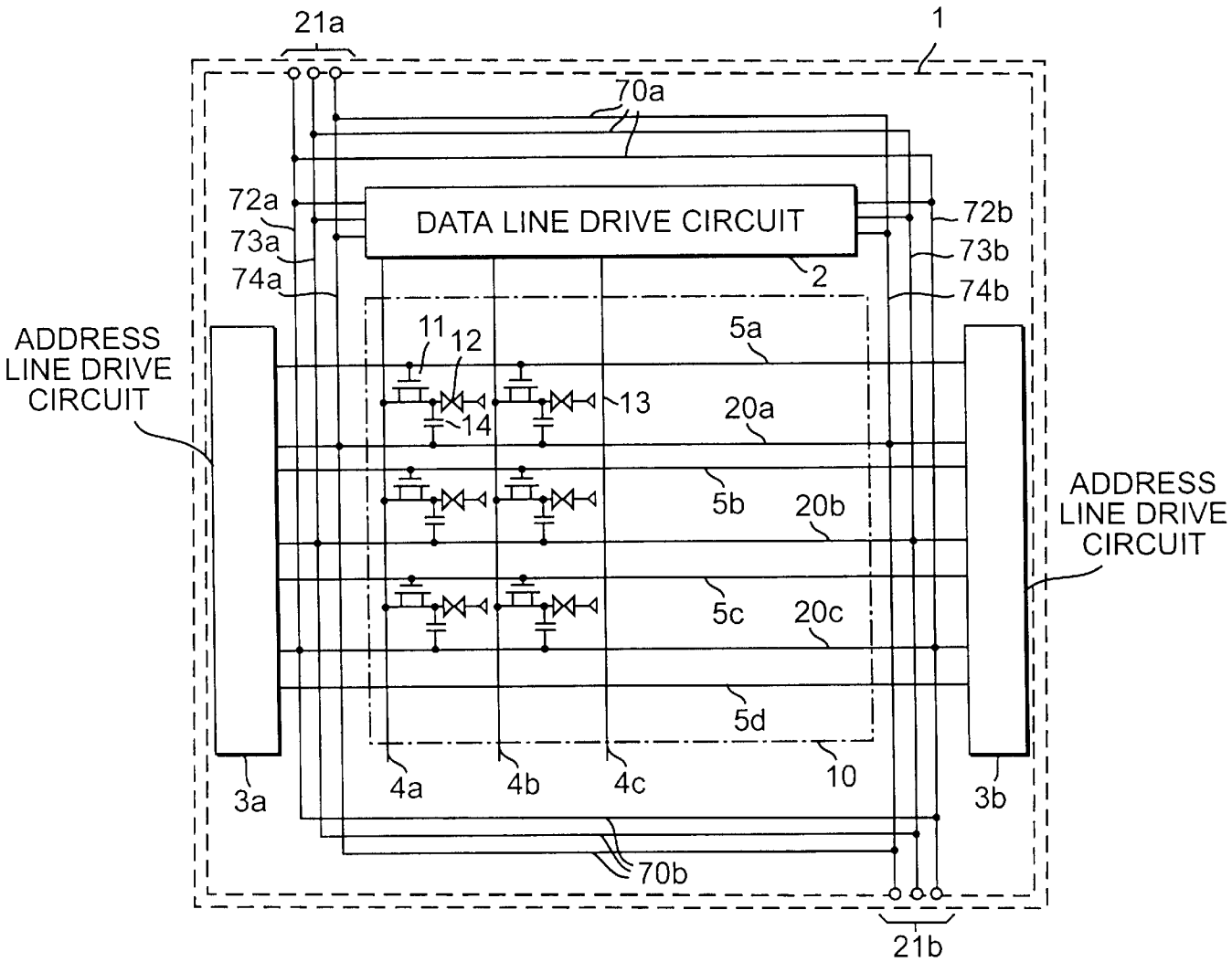
FIG. 2 is a diagram showing the construction of a liquid crystal display device of the active matrix type according to a first embodiment.

FIG. 2 is a view showing the construction of a liquid crystal display device according to a first embodiment of the present invention.

In this liquid crystal display device, pixel electrodes, not shown, are arranged in matrix fashion in a display region 10 on a glass substrate 1, storage capacitors 14 with TFT 11 being connected to respective pixel electrodes. Display region 10 is a region wherein pixel electrodes are arranged in matrix fashion and that includes signal wiring of various types connected to the pixels. The calibration conditions in display region 10 are shown by an equivalent circuit. The drains of TFTs 11 are connected to data lines 4*a*,4*b*,4*c*~, and their gate electrodes are connected respectively to address lines 5*a*,5*b*,5*c*~. One end of storage capacitance 14 is connected to the source electrode, while its other end is connected to Cs lines 20*a*,20*b*,20*c*~. In this case, TFTs were employed, but it would also be possible to employ other active elements instead of TFTS, for example TFDS, to constitute the active matrix.

The non-display region(border region) on glass substrate 1 is the remaining region after subtracting the display region form the entire liquid crystal display device. In this non-display region, there are provided a data line drive circuit 2 and address line drive circuits 3*a*,3*b*, and, in addition, there are provided power source supply wirings 70*a*,70*b*. The address line drive circuit 3 is divided into two parts arranged on the left and right respectively(3*a* and 3*b*). Power source supply wirings 70*a*,70*b* are supplied with prescribed power source potentials from terminals 21*a*,21*b*. In this way, the power source voltages of drive circuit 2,3 are applied in accordance with the respective potentials form terminals 21*a*,21*b* through the respective power source wirings 72*a*, 72*b*, 73*a*,73*b*,74*a*,74*b*.

Also, a counter substrate 21 formed with a transparent common electrode (counter electrode) made of ITO is arranged opposite display region 10 of array substrate 1 constructed as above, and a liquid crystal layer 12 is sealed between these respective substrates.

In addition to this, a chief characteristic of this embodiment is that the storage capacitance lines(herein below called Cs lines)20 (20*a*,20*b*,20*c*~) are not connected in common but are divided into three groups, which are respectively connected to wirings 72,73 and 74. Specifically, Cs line 20*a* is connected at the left side to 74*a* and at the right side to 74*b*; Cs line 20*b* is connected at the left side to 73*a* and at the right side to 73*b*; and Cs line 20*c* is connected at the left side to 72*a* and at the right side to 72*b*.

Thus, in this embodiment, a lowering of the power source wiring resistance is achieved by connecting the respective wirings 72*a*,72*b*,73*a*,73*b*, and 74*a*,74*b* to Cs lines 20*a*,20*b*, 20*c*,~, which are wired to each pixel as reference potential lines of storage capacitors 14. Wirings (74*a*,74*b*),(73*a*,73*b*), and (72*a*,72*b*) are respectively GND potential, power source for the logic circuitry(plus power source potnetial or minus power source potential), and potential for the analog circuitry and gate voltages (intermediate potential of ±power source potentials).

Figure 3:
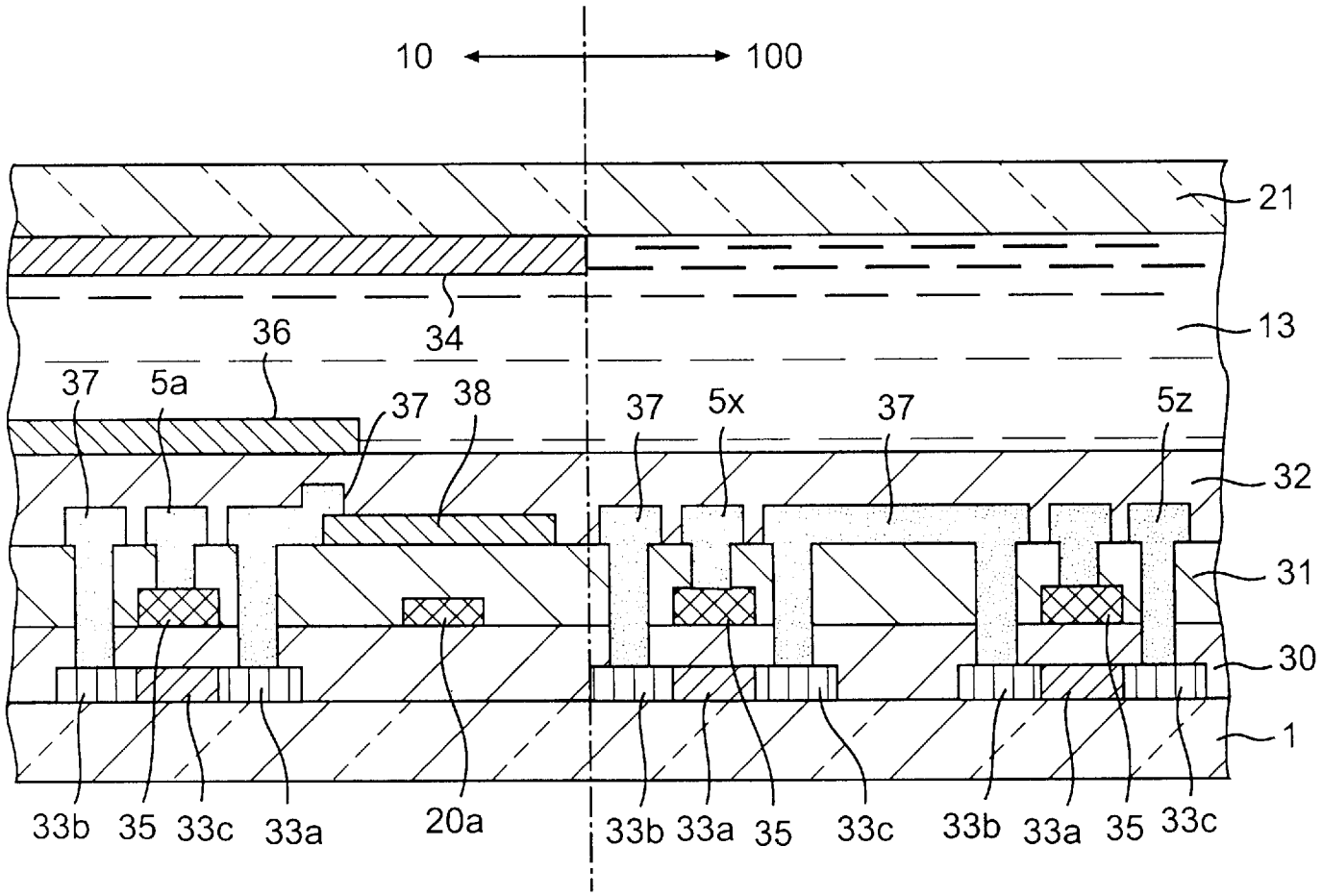
FIG. 3 is a cross-sectional view showing the construction of a liquid crystal display device of the active matrix type according to the first embodiment.

FIG. 3 shows the cross-sectional construction of the major portion of an active matrix liquid crystal display device as described above. In the following description, parts which are the same as in FIG. 2 are given the same reference numeral and further detailed description is omitted.

10 indicates the display region and 100 indicates the non-display region. 33*a*, 33*b*,33*c* are polycrystalline Si films formed by melting and solidifying an amorphous Si thin film on glass substrate 1 by the laser beam annealing method. These polycrystline Si films 33*a*, 33*b*,33*c* respectively correspond to the source regions, drain regions and channel regions of the TFTs. Also, a metallic gate electrode 35 is formed on the other side of a gate insulating film 30 made of silicon oxide opposite these polycrystalline Si films 33*a*, 33*b*, 33*c*. 38 is an ITO pixel electrode. 5*a*,5*x*,5*y*,5*z* are electrode wirings connected to the source region, drain region, and channel region 33*a*,33*b*, and 33*c*. 36 is a black matrix that blocks the incidence of light on to the TFTs.

34 is an ITO counter electrode. For the TFTs formed in non-display region 10, a CMOS construction consisting of P type TFTs and N type TFTs is adopted.

An active matrix liquid crystal display device according to this embodiment is a color VGA(number of pixel 480×640×3) of 9.5 diagonal size, the number of Cs lines that are formed is the same as the number of gate lines i.e. 480. As shown in FIG. 1, the Cs lines are successively connected to power source wirings(74*a*,74*b*),(73*a*,73*b*),(72*a*, 72*b*), and respectively 160 Cs lines are connected to each power source wiring. The Cs lines are formed by composite films of 350 nm Al alloy thin film and MoW thin film, the sheet resistance being 0.1 Ω/□. Each Cs line is of length 200 mm, width 20 μm, and its resistance is 1K Ω, but, since 160 lines are connected in parallel, the resistance is 6.3 Ω, corresponding equivalently to wiring of length 200 mm width 3.2 mm.

In this embodiment, resistance is further lowered by arranging other chief power source wirings 70*a*,70*b* outside the display region, but thanks to the use of the Cs wiring as power source wiring, a region of 3.2×3=9.6 mm can be saved with regard to the wiring region forming 70*a*,70*b*.

Thus, with this embodiment, savings can be effected in regard to the amount of non-display region required by the liquid crystal display device, enabling a liquid crystal device of smaller size to be achieved. Furthermore, since each Cs line is capacitively coupled with the data lines and liquid crystal layer, the capacitance per Cs line is about 800 pF. Thus, a capacitance of 0.13 μF is formed by the 160 lines, so this has the benefit of stabilizing voltage fluctuations of the power supply line.

(Second embodiment)

Figure 4:
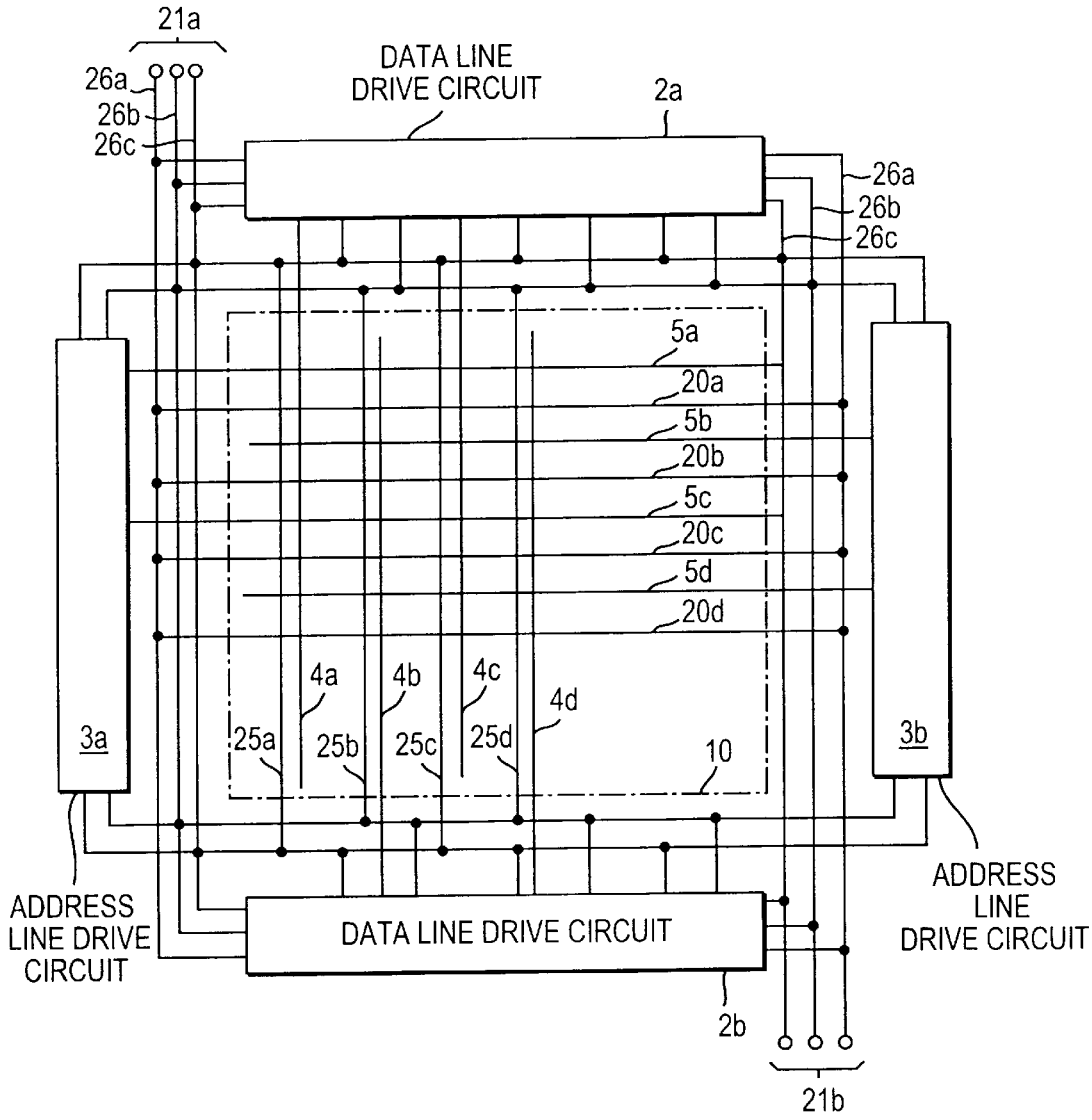
FIG. 4 is a diagram showing the construction of a liquid crystal display device of the active matrix type according to a second embodiment.

FIG. 4 is a view showing the layout of a liquid crystal display device according to a second embodiment of the present invention. Parts which are the same a in FIG. 1 are given the same reference symbols and further detailed description is omitted. Also, the glass substrate and TFT and storage capacitors etc. are not shown.

The basic construction is the same as in the case of FIG. 1, but, in this embodiment, not only the Cs lines 20 but also black matrix 25 is employed as part of the power source wiring. Also, the data line drive circuit is divided into upper and lower parts(2*a*,2*b*).

Power source wiring 26*a* forms a GND line and Cs lines 20*a*,20*b*,20*c*,20*d*~ are connected to this power source wiring 26*a*. Power source wirings 26*b*,26*d* constitute power source line for the respective logic circuit power source and analog circuit power sources; the upper and lower region of the screen are selectively connected to these power source wirings 26*c*,26*b*, by wirings 25*a*,25*c*, ~ and 25*b*,25*d*, ~, also serving as the black matrix.

The active matrix liquid crystal display device of this embodiment is for a color XGA(pixel number is 769×1024×3) of 12.1 diagonal size; power source potential is supplied form external connection terminals 21*a*,21*b*. Power source wiring 26*a* constitutes an earth line and is connected to 768 Cs lines 20*a*,20*b*,20*c*,20*d*~. The Cs lines are constituted of composite film of TaMo thin film and Al thin film of sheet resistance 0.1 Ω/□, of length 250 mm, width 20 μm, the resistance per line being 1.25 k Ω. However, since 768 of these are connected in parallel, the left and right regions of the screen are connected with a total resistance of 1.6 Ω. This corresponds to a total wiring width of 15.4 mm.

Power source wiring 26*c* constitutes the logic circuitry power source line and 26*b* constitutes the power source line for the analog voltages. Also, the upper and lower regions of the screen are connected to wirings 25*a*,25*c*, ~ and 25*b*,25*d*, ~,which also serve as black matrix. 1536 wirings are respectively arranged in parallel, being constitutes of composite wirings of TaMo thin film and Al thin film of sheet resistance 0.1 Ω/□. The length of these is 190 mm, and their width 30 μm, the resistance per wiring being 630 Ω, but the resistance when they are connected in parallel is 0.4 Ω. The equivalent wiring widths are respectively 46 mm in each case.

Figure 5:
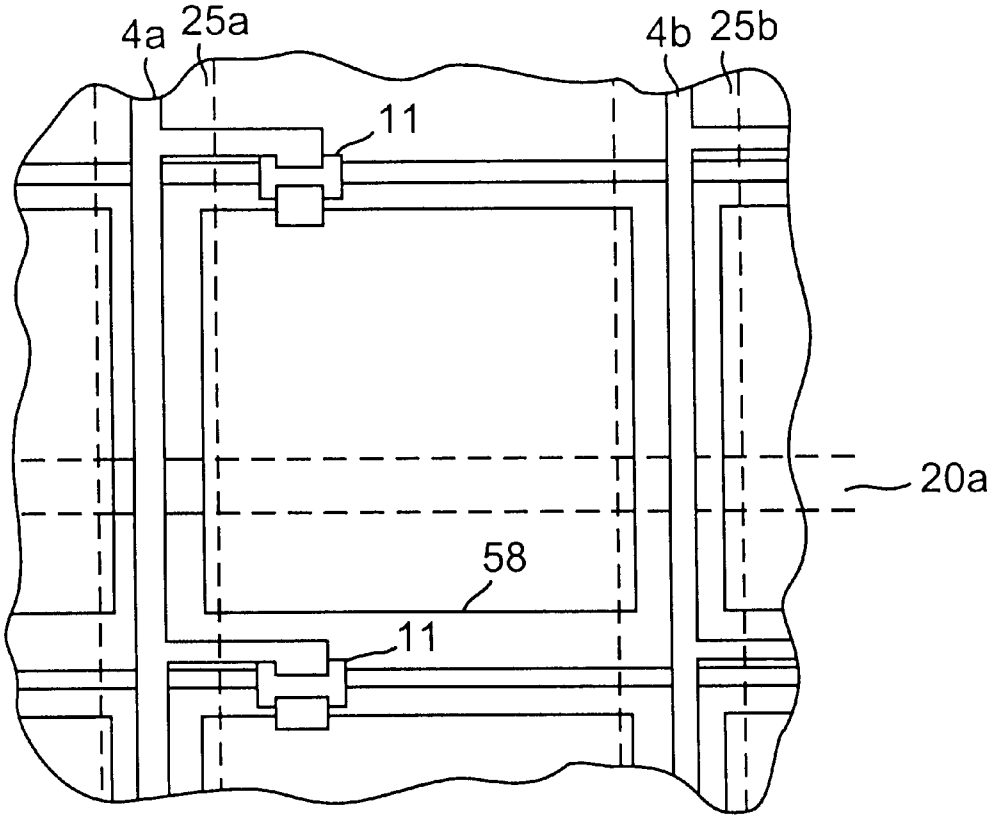
FIG. 5 is a plan view showing the construction of a single pixel in the second embodiment.

FIG. 5 shows a plan view a pixel of this embodiment. The Cs line that is connected to power source wiring 26*a* corresponds to 20*a*; the black matrix wiring that is connected to the power source wiring 26*c* corresponding to wiring 25*a* arranged below the data line. The black matrix wiring that is connected to power source wiring 26*b* corresponds to wiring 25*b* that is arranged below the data line. 58 is a pixel electrode.

These Cs lines 20*a* and black matrix wirings 25*a*,25*b* are both employed for lowering the impedance of the power source wiring, but they also serve the original function of the reference potential lines for the storage capacitance and as black matrix; high display quality can be achieved by this construction.

The total width of power source wiring at the periphery of the display region that can be saved by the construction of this embodiment is 15.4+2×46=107.2 mm. This construction is also favorable in regard to the drive circuit power source wiring in that the respective wiring have a stray capacitance with respect to the wirings and liquid crystal layer, resulting in a large total capacitance of 0.2~0.4 μF, thus also serving to provide the function of a high pass filter, which is necessary for stabilization of the power source potential.

It should be noted that the present invention is not restricted to the embodiments described above. For example, apart from that described in the embodiment, as a fixed-potential wiring constituted in the display region of the liquid crystal display device, a black matrix made of metallic thin film provided on the counter substrate side may be employed as part of the power source supply wiring. In this case, the black matrix on the counter substrate side and the TFT array substrate may be connected by a conductive paste provided between there. Apart from this, the present invention may be put into practice modified in various ways without departing from its essence. The present invention is therefore not restricted to liquid crystal display devices, but could be applied to other active matrix display devices also. For example,it could be applied to a plasma display device of the active matrix type whose construction is the same as that described with reference to FIG. 2 with the exception that miniature discharge tubes are employed as the pixels instead of the liquid crystal pixels constituted by interposing a liquid crystal layer between a pixel electrode and counter electrode, for example. In this case, an image in which the quantity of light of the miniature vacuum tubes is controlled by TFTs can be displayed.

What is claimed is:

1. An active matrix display device comprising an insulating substrate divided into a display region and a non-display region;

a plurality of active elements arranged in matrix fashion on the insulating substrate in the display region and a plurality of pixel electrodes each connected to one of the active elements, the pixel electrodes being in the display region;

an address drive circuit, in the non-display region, for controlling the active elements by supplying an address signal to the active elements;

a data drive circuit in the non-display region, for supplying picture data to the active elements;

a counter electrode facing the pixel electrodes;

a liquid crystal layer between the counter electrode and the pixel electrodes, the optical transmittance of the liquid crystal layer varying according to an electrical field applied between the pixel electrodes and the counter electrode; and a power source supply wiring, in the display region, for supplying a power source potential to the address drive circuit or the data drive circuit.

2. The active matrix display device according to claim 1, wherein: the active elements each includes a TFT having a polycrystalline semiconductor channel region.

3. The active matrix display device according to claim 1, wherein: the power source supply wiring is connected, at a plurality of locations, to the address drive circuit or the data drive circuit to supply the power source potential in a substantially stable manner.

4. The active matrix display device according to claim 3, wherein the power source potential, is higher or lower than a ground potential.

5. The active matrix display device according to claim 4, further comprising a second power source supply wiring, in the display region, for supplying the ground potential to the address drive circuit or the data drive circuit.

6. An active matrix display device comprising:

an insulating substrate divided into a display region and a non-display region;

a plurality of active elements arranged in matrix fashion on the insulating substrate in the display region and a plurality of pixel electrodes each connected to one of the active elements, the pixel electrodes being in the display region;

an address drive circuit, in the non-display region, for controlling the active elements by supplying an address signal to the active elements;

a data drive circuit in the non-display region, for supplying picture data to the active elements;

a counter electrode facing the pixel electrodes;

a liquid crystal layer between the counter electrode and the pixel electrodes, the optical transmittance of the liquid crystal layer varying according to an electrical field applied between the pixel electrodes and the counter electrode; and Cs lines, in the display region, for supplying a DC power source potential to the address drive circuit or the data drive circuit, the Cs lines defining storage capacitors between each pixel electrode and a corresponding Cs line and the Cs lines being between the substrate and the counter electrode.

7. The active matrix display device according to claim 6, wherein the active elements and address drive circuit are connected by a plurality of address lines in parallel on the insulating substrate within the display region and the active elements and the data drive circuit are connected by a plurality of data lines in parallel running along the address lines on the insulating substrate in the display region.

8. The active matrix display device according to claim 7, wherein the active elements and the drive circuit include TFTs formed on the insulating substrate with a channel region of polycrystalline silicon.

9. The active matrix display device according to claim 8, wherein the address drive circuit is divided between the non-display regions to the left and right of the display region, these divided parts being connected by address lines passing through the display region.

10. The active matrix display device according to claim 8, further comprising power supply wiring in the non-display region wherein the Cs lines and the power source supply wiring are connected at two points at opposite sides of the display region, to define a four-sided rectangular shape.

11. An active matrix display device comprising:

an insulating substrate divided into a display region and a non-display region;

a plurality of active elements arranged in matrix fashion on the insulating substrate in the display region and a plurality of pixel electrodes connected to one of the active elements, the pixel electrodes being in the display region;

an address drive circuit, in the non-display region, for controlling the active elements by supplying an address signal to the active elements;

a data drive circuit in the non-display region, for supplying picture data to the active elements, wherein the active elements and address drive circuit are connected by a plurality of address lines in parallel on the insulating substrate within the display region, the active elements and the data drive circuit being connected by a plurality of data lines in parallel running along the address lines on the insulating substrate in the display region, and the active elements and the drive circuit include TFTs formed on the insulating substrate with a channel region of polycrystalline silicon;

a counter electrode facing the pixel electrodes;

a liquid crystal layer between the counter electrode and the pixel electrodes, an optical transmittance of the liquid crystal layer varying according to an electric field applied between the pixel electrodes and the counter electrode; and Cs lines, in the display region, for supplying a power source potential to the address drive circuit or the data drive circuit, the Cs lines defining storage capacitors between each pixel electrode and a corresponding Cs line, the Cs lines being between the substrate and the counter electrode;

wherein the Cs lines are divided into at least three groups, a first group for supplying a ground potential, a second group for supplying a second potential higher or lower than the ground potential, and a third group for supplying a potential between the ground potential and the second potential.

12. The active matrix display device according to claim 11, wherein the address drive circuit is divided between the non-display regions to the left and right of the display region, these divided parts being connected by address lines passing through the display region.

13. The active matrix display device comprising:

an insulating substrate divided into a display region and a non-display region;

a plurality of active elements arranged in matrix fashion on the insulating substrate in the display region and a plurality of pixel electrodes each connected to one of the active elements, the pixel electrodes being in the display region;

an address drive circuit, in the non-display region, for controlling the active elements by supplying an address signal to the active elements;

a data drive circuit in the non-display region, for supplying picture data to the active elements;

a counter electrode facing the pixel electrodes;

a liquid crystal layer between the counter electrode and the pixel electrodes, the optical transmittance of the liquid crystal layer varying according to an electrical field applied between the pixel electrodes and the counter electrode; and a black matrix on the display region that supplies power source potential to the address drive circuit or the data drive circuit, the black matrix being at least between the pixel electrodes.

14. The active matrix display device according to claim 13, wherein the black matrix and the power source supply wiring for the data drive circuit are simultaneously connected with one side and the other side in the vicinity of two different sides of the display region, which presents a four-sided rectangular shape.

15. The active matrix display device according to claim 13, wherein the active elements and address drive circuit are connected by a plurality of address lines in parallel on the insulating substrate within the display region, and the active elements and the data drive circuit are connected by a plurality of data lines running along the address lines on the insulating substrate within the display region.

16. The active matrix display device according to claim 15, wherein the data drive circuit is divided between non-display regions above and below the display region, these divided parts being connected by data line passing through the display region.

17. The active matrix display device according to claim 15, wherein the black matrix is superimposed on the data lines and forms capacitive coupling with the data lines.

18. An active matrix display device comprising:

an insulating substrate divided into a display region and a non-display region;

a plurality of active elements arranged in matrix fashion on the insulating substrate in the display region and a plurality of pixel electrodes connected to one of the active elements, the pixel electrodes being in the display region;

an address drive circuit, in the non-display region, for controlling the active elements by supplying an address signal to the active elements;

a data drive circuit in the non-display region, for supplying picture data to the active elements, wherein the active elements and address drive circuit are connected by a plurality of address lines in parallel on the insulating substrate within the display region, and the active elements and the data drive circuit are connected by a plurality of data lines running along the address lines on the insulating substrate within the display region;

a counter electrode facing the pixel electrodes;

a liquid crystal layer between the counter electrode and the pixel electrodes, an optical transmittance of the liquid crystal layer varying according to an electric field applied between the pixel electrodes and the counter electrode; and a black matrix on the display region that supplies power source potential to the address drive circuit or the data drive circuit, the black matrix being at least between the pixel electrodes;

wherein the black matrix is divided into at least three groups, a first group for supplying a ground potential, a second group for supplying a second potential higher or lower than the ground potential, and a third group for supplying a potential between the ground potential and the second potential.

19. The active matrix display device according to claim 18, wherein the black matrix and the power source supply wiring for the data drive circuit are simultaneously connected with one side and the other side in the vicinity of two different sides of the display region, which presents a four-sided rectangular shape.

20. The active matrix display device according to claim 18, wherein the data drive circuit is divided between non-display regions above and below the display region, these divided parts being connected by data line passing through the display region.

21. The active matrix display device according to claim 18, wherein the black matrix is superimposed on the data lines and forms capacitative coupling with the data lines.

22. The active matrix display device comprising;

an insulating substrate having two opposite main surfaces, the middle part of one main surface constituting a display region while the rest constitutes a non-display region;

a plurality of pixels in the display region;

a drive circuit, in the non-display region, for driving the pixels;

a power source supply wiring, in the non-display region, for supplying a power source potential to the drive circuit; and a cross wiring, in the display region, connected at a plurality of locations to the power source supply wiring.

23. The active matrix display device according to claim 22, further comprising a plurality of cross wirings arranged in groups, each group for supplying a different supply potential.

24. The active matrix display device according to claim 23, wherein the power source supply wiring of the drive circuits and the cross wiring groups are simultaneously connected at one side and another side at two different sides of said display region, which defines a four-sided rectangular shape.

25. The active matrix display device according to claim 23, wherein the pixels and the drive circuits include TFTs whose channel regions comprise polycrystalline silicon.

26. The active matrix display device according to claim 23, wherein the power source potential is higher or lower than a ground potential.

* * * * *